US010208753B2

(12) United States Patent
Forni et al.

(10) Patent No.: US 10,208,753 B2
(45) Date of Patent: Feb. 19, 2019

(54) THERMAL/NOISE MANAGEMENT IN A SCROLL PUMP

(71) Applicant: AGILENT TECHNOLOGIES, INC., Loveland, CO (US)

(72) Inventors: Ronald J. Forni, Lexington, MA (US); Vannie (Yucong) Lu, Billerica, MA (US); Arti Desai, Lexington, MA (US)

(73) Assignee: Agilent Technologies, Inc., Santa Clara, CA (US)

( * ) Notice: Subject to any disclaimer, the term of this patent is extended or adjusted under 35 U.S.C. 154(b) by 1177 days.

(21) Appl. No.: 13/902,533

(22) Filed: May 24, 2013

(65) Prior Publication Data

US 2014/0294638 A1 Oct. 2, 2014

Related U.S. Application Data

(63) Continuation-in-part of application No. 13/853,655, filed on Mar. 29, 2013, now Pat. No. 9,611,852.

(51) Int. Cl.

| | |
|---|---|
| ***F04C 29/04*** | (2006.01) |
| ***F04C 28/28*** | (2006.01) |
| ***F04C 18/02*** | (2006.01) |

(52) U.S. Cl.

CPC ..... *F04C 29/04* (2013.01); *F04C 18/0215* (2013.01); *F04C 28/28* (2013.01); *F04C 29/047* (2013.01)

(58) Field of Classification Search

CPC ..... F04C 29/04; F04C 18/0215; F04C 28/28; F04C 29/047; H01S 3/10015; H01S 3/094011; H01S 3/0014; H01S 3/067

USPC ..... 310/62, 63, 53; 417/228

See application file for complete search history.

(56) References Cited

U.S. PATENT DOCUMENTS

| | | | |
|---|---|---|---|
| 3,644,067 | A | 2/1972 | Yowell |
| 4,676,473 | A | 6/1987 | Giles |
| 5,417,554 | A | 5/1995 | Kietzman et al. |
| 5,467,111 | A | 11/1995 | Furukawa et al. |
| 5,653,125 | A | 8/1997 | Boyanich |
| 5,957,667 | A | 9/1999 | Epp |
| 6,093,005 | A | 7/2000 | Nakamura |

(Continued)

FOREIGN PATENT DOCUMENTS

| | | |
|---|---|---|
| WO | WO2009105627 | 8/2009 |

OTHER PUBLICATIONS

Non-Final Office action dated Jun. 20, 2016 from related U.S Appl. No. 13/853,655.

(Continued)

*Primary Examiner* — Charles Freay
*Assistant Examiner* — Lilya Pekarskaya

(57) ABSTRACT

The speed of a cooling fan of a scroll pump is controlled such that fan-generated noise can be kept low. The scroll pump includes a pump head, a pump motor, the fan, a controller and one or more sensors. The pump head includes a plate scroll set in which a tip seal is provided to create a seal between the blade and the opposing plates of the plate scrolls of the set. The speed of the fan is cycled by the controller, and the power draw on the pump motor as a result is checked. These results are used to infer the state of the pump, i.e., to discriminate several different states of the pump from one another, including a state in which a new tip seal is being worn in, and to control the speed of the fan accordingly.

9 Claims, 7 Drawing Sheets

1

(56) References Cited

U.S. PATENT DOCUMENTS

| | | | | |
|---|---|---|---|---|
| 6,190,145 | B1 | 2/2001 | Fujioka et al. | |
| 6,321,563 | B1 | 11/2001 | Ikeda et al. | |
| 6,450,275 | B1 * | 9/2002 | Gabriel | B60K 6/22 165/41 |
| 7,387,503 | B2 | 6/2008 | Toda et al. | |
| 7,398,855 | B2 | 7/2008 | Seel | |
| 7,442,016 | B2 | 10/2008 | Dovey et al. | |
| 7,583,043 | B2 | 9/2009 | Chung et al. | |
| 7,753,996 | B1 | 7/2010 | Deane et al. | |
| 8,177,534 | B2 | 5/2012 | Ni | |
| 8,562,317 | B2 | 10/2013 | Fujioka et al. | |
| 2002/0039534 | A1 | 4/2002 | Moroi et al. | |
| 2004/0109772 | A1 | 6/2004 | Ogawa et al. | |
| 2004/0241030 | A1 | 12/2004 | Matsushima | |
| 2005/0169788 | A1 | 8/2005 | Komai et al. | |
| 2005/0235660 | A1 * | 10/2005 | Pham | F04C 28/00 62/126 |
| 2007/0077159 | A1 | 4/2007 | Tsuchiya et al. | |
| 2007/0178001 | A1 | 8/2007 | Minekawa et al. | |
| 2008/0145258 | A1 | 6/2008 | Metzger et al. | |
| 2008/0152525 | A1 * | 6/2008 | Tsuchiya | F04C 29/04 418/55.1 |
| 2009/0087331 | A1 | 4/2009 | Komai et al. | |
| 2009/0269220 | A1 | 10/2009 | Nakagawa et al. | |
| 2010/0076728 | A1 * | 3/2010 | Yanao | G05B 23/0237 702/183 |
| 2010/0111740 | A1 * | 5/2010 | Ni | F04C 18/0253 418/55.2 |
| 2010/0221134 | A1 | 9/2010 | Kanaizumi et al. | |
| 2010/0223947 | A1 | 9/2010 | Shibuya | |
| 2012/0315165 | A1 | 12/2012 | Dreifert et al. | |
| 2012/0315174 | A1 | 12/2012 | Iwano et al. | |

OTHER PUBLICATIONS

Search Report dated Oct. 14, 2014 in Application No. GB1403289.0.

Office action dated Oct. 15, 2015 from U.S. Appl. No. 14/094,683.

Office action dated Feb. 29, 2016 from related U.S. Appl. No. 13/853,655.

* cited by examiner

THERMAL/NOISE MANAGEMENT IN A SCROLL PUMP

CROSS-REFERENCE TO RELATED APPLICATIONS

This application is a Continuation-In-Part of U.S. Ser. No. 13/853,655 filed on Mar. 29, 2013.

BACKGROUND OF THE INVENTION

1. Field of the Invention

The present invention relates to a scroll pump having a pump head assembly that includes a stationary plate scroll and an orbiting plate scroll, a pump motor coupled to the orbiting plate scroll so as to drive the orbiting plate scroll, and means for cooling one or more components of the pump. In particular, the present invention relates to a method of and means for regulating the temperature of components of a scroll pump.

2. Description of the Related Art

A scroll pump is a type of pump that includes a stationary plate scroll having a stationary plate and a spiral stationary scroll blade projecting axially therefrom, and an orbiting plate scroll having an orbiting plate and a spiral orbiting scroll blade projecting axially therefrom. The stationary and orbiting scroll blades are nested with a clearance and predetermined relative angular positioning, and a seal is provided between the tip (free end) of the scroll blade of one (or both of) the plate scrolls and the plate (or plates of) the other plate scroll such that a pocket (or pockets) is delimited by and between the stationary and orbiting scroll blades. The stationary plate scroll is fixed in the pump. The orbiting plate scroll and hence, the orbiting scroll blade, is coupled to an eccentric driving mechanism. The stationary and orbiting plate scrolls and the eccentric drive mechanism may make up what is referred to as a pump head or pump head assembly.

The eccentric drive mechanism is, in turn, connected to and driven by a motor of the pump such that the orbiting scroll plate orbits about a longitudinal axis of the pump passing through an axially central portion of the stationary scroll blade. The volume of the pocket(s) delimited by the scroll blades of the pump is varied as the orbiting scroll blade moves relative to the stationary scroll blade. The orbiting motion of the orbiting scroll blade also causes the pocket(s) to move within the pump head assembly such that the pocket(s) is selectively placed in open communication with an inlet and outlet of the scroll pump.

In an example of such a scroll pump, the motion of the orbiting scroll blade relative to the stationary scroll blade causes a pocket sealed off from the outlet of the pump and in open communication with the inlet of the pump to expand. Accordingly, fluid is drawn into the pocket through the inlet. Then the pocket is moved to a position at which it is sealed off from the inlet of the pump and is in open communication with the outlet of the pump, and at the same time the pocket is compressed. Thus, the fluid in the pocket is compressed and thereby discharged through the outlet of the pump.

In the case of a vacuum-type of scroll pump, the inlet of the pump is connected to a chamber that is to be evacuated. Conversely, in the case of a compressor-type of scroll pump, the outlet of the pump is connected to a chamber that is to be supplied with pressurized fluid by the pump. In either case, various components of the pump produce significant amounts of heat which may reduce the useful life of the components or worse, cause an operational failure of the pump.

Therefore, scroll pumps are provided with one or more cooling fans to cool the pump. However, the fan(s) may be a significant source of noise which is detrimental in the workplace.

SUMMARY OF THE INVENTION

It is an object of the present invention to provide a method of controlling the fan speed in a scroll pump to match the cooling requirements of the pump, whereby the fan-generated noise of the pump is minimal.

It is still another object of the present invention to provide a method in the thermal management of a scroll pump that takes into account the installation of a new tip seal between orbiting and stationary plate scrolls of the pump.

It is likewise another object of the present invention to provide a scroll pump that includes a thermal management system including a cooling fan and a controller that will control the fan appropriately, without a user input, just after a new tip seal has been installed between orbiting and stationary plate scrolls of the pump.

According to one aspect of the present invention, there is provided a method of monitoring at least one load (intrinsic and/or external) on a scroll pump, analyzing the at least one load being monitored to determine whether a new tip seal, providing a seal between an axial tip of the scroll blade of one of the plate scrolls and the plate of the other of the plate scrolls, has just been installed, and regulating the speed of a cooling fan of the scroll pump on the basis of the analysis of the at least one load on the pump.

According to another aspect of the present invention, there is provided a method in the thermal management of a scroll pump, comprising: periodically measuring the power or current being drawn by the pump motor and storing a value of the power or current each time it is measured, comparing the value of the measured power or current with the stored value of the previously measured power or current, and a fan control process that controls the fan appropriately for at least a burnishing operation on the basis of an analysis of changes in the power or current being drawn by the pump motor. The value of the measured power or current being drawn by the pump motor is compared with the stored value of the previously measured power or current each successive time the power or current being drawn by the pump motor is being measured. The fan control process includes reducing or increasing the speed at which the fan is running, while the scroll pump is operating, when a comparison between the value of the measured power or current being drawn by the pump motor and the stored value of the previously measured power or current yields a given result. Also, the periodic measuring of the power or current being drawn by the pump motor includes measuring the power or current being drawn by the pump motor after each time the speed of the cooling fan is reduced or increased once a given time has elapsed. And, the fan control process also includes maintaining a reduced fan speed for a predetermined period of time after a comparison between the value of the power or current being drawn by the pump motor, measured once said given time has elapsed after the speed of the fan has been reduced or increased, and the stored value of the previously measured power or current indicates that the power or current being drawn by the pump motor can be reduced by operating the cooling fan at a reduced speed.

According to still another aspect of the present invention there is provided a scroll pump which includes a pump motor, a pump head assembly, and a thermal management system which takes into account whether a new tip seal has just been installed in the pump head assembly. The thermal management system includes a multi-speed cooling fan disposed upstream of the pump head assembly in the pump with respect to the direction of air flow produced by the fan, so as to cool at least the pump head assembly in the pump, at least one sensor that monitors a respective load on the pump, and an electronic controller operatively connected to the at least one sensor and to the fan motor. The cooling fan has a fan blade, and a fan motor connected to the fan blade and operable to rotate the fan blade at any of several different speeds. The controller is configured to analyze the respective load or loads on the pump monitored by the at least one sensor, determine whether a new tip seal has just been installed, and control the fan motor to regulate the speed of the fan blade on the basis of the analysis of the respective load or loads on the pump.

BRIEF DESCRIPTION OF THE DRAWINGS

These and other objects, features and advantages of the present invention will be better understood from the detailed description of the preferred embodiments thereof that follows with reference to the accompanying drawings, in which.

DETAILED DESCRIPTION OF THE PREFERRED EMBODIMENTS

Figure 1:
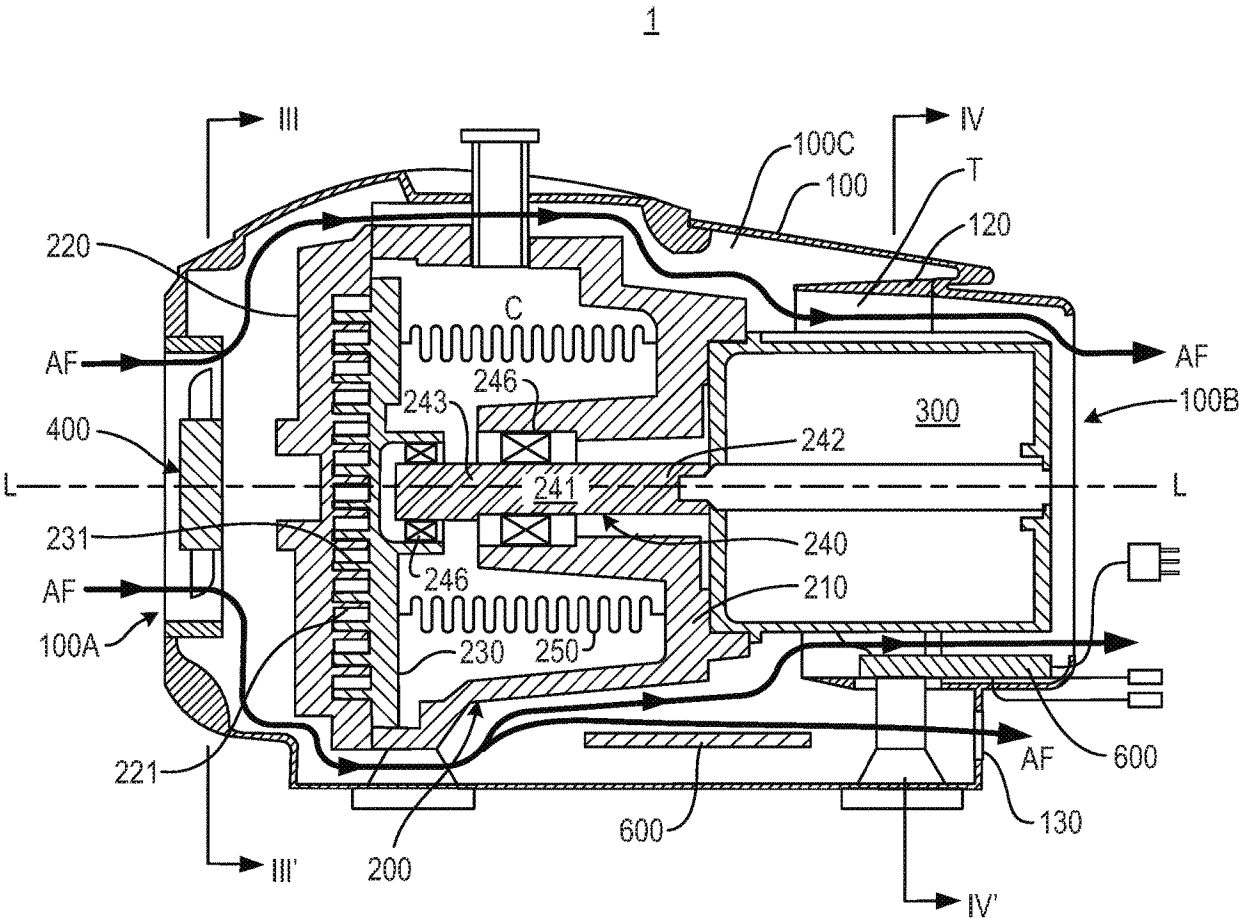
FIG. 1 is a schematic longitudinal sectional view of a simplified version of a scroll pump according to the present invention.

Various embodiments and examples of embodiment of the inventive concept will be described more fully hereinafter with reference to the accompanying drawings. In the drawings, the sizes and relative sizes of elements may be exaggerated for clarity. Likewise, the shapes of elements may be exaggerated and/or simplified for clarity and ease of understanding. Also, like numerals and reference characters are used to designate like elements throughout the drawings.

Furthermore, spatially relative terms, such as "front" and "back" are used to describe an element's relationship to another element(s) as illustrated in the figures. Thus, the spatially relative terms may apply to orientations in use which differ from the orientation depicted in the figures. Obviously, though, all such spatially relative terms refer to the orientation shown in the drawings for ease of description and are not necessarily limiting as apparatus according to the invention can assume orientations different than those illustrated in the drawings when in use.

Other terminology used herein for the purpose of describing particular examples or embodiments of the inventive concept is to be taken in content. For example, the terms "comprises" or "comprising" when used in this specification indicates the presence of stated features or processes but does not preclude the presence of additional features or processes. The term "pump" may refer to apparatus that drives, or raises or decreases the pressure of a fluid, etc. The term "fixed" may be used to describe a direct connection of two parts to one another in such a way that the parts can not move relative to one another or a connection of the parts through the intermediary of one or more additional parts in such a way that the parts can not move relative to each other. Also, the term "measure" as used in connection with a process of measuring a parameter (power or current, for example) may refer to a sampling or measuring of the parameter many times over a relatively short period and an averaging of those values for the sake of accuracy. That is, the term "measurement" may refer to obtaining a time-averaged value of a particular parameter produced before the parameter is used in the next step, e.g., in a comparison process.

Referring now to FIG. 1, a scroll pump 1 to which the present invention may be applied includes a cowling 100, and a pump head assembly 200, a pump motor 300, and a cooling fan 400 housed in the cowling 100. More specifically, the pump head assembly 200, pump motor 300 which may be an electric motor, an air motor, or other suitable type of motor, and cooling fan 400 are juxtaposed with one another along a longitudinal axis L of the pump 1, i.e., in an axial direction of the pump 1. Furthermore, the cowling 100 has opposite ends in the axial direction. The ends of the cowling 1 define an air inlet 100A and an air outlet 100B, respectively. The air outlet 100B may be in the form of a grill.

The pump head assembly 200 includes a frame 210, a stationary plate scroll 220, an orbiting plate scroll 230, an eccentric drive mechanism 240, an annular metallic bellows 250 and fasteners (not shown) fixing the stationary plate scroll 220 to the frame 210 and the metallic bellows 250 to both the frame 210 and the orbiting plate scroll 230.

Figure 2:
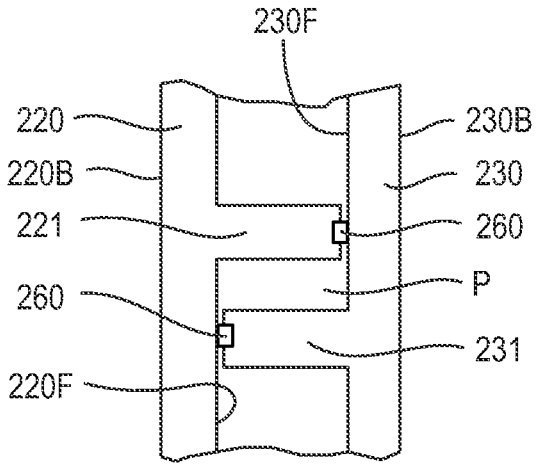
FIG. 2 is a schematic enlarged longitudinal sectional view of portions of the stationary and orbiting scroll blades of the scroll pump.

Furthermore, and with reference to FIG. 1 and FIG. 2, the stationary plate scroll 220 has a front side 220F and a back side 220B, and comprises a stationary scroll blade 221 at its front side 220F. The orbiting plate scroll 230 has a front side 230F and a back side 230B, and comprises an orbiting scroll blade 231 at its front side 230F. The stationary scroll blade 221 and the orbiting scroll blade 231 are nested with a clearance and predetermined relative angular positioning such that a pocket P or pockets is/are delimited by and between the stationary and orbiting scroll blades. In this respect, side surfaces of the scroll blades 221 and 231 need not contact each other to seal the pocket(s). Rather, minute clearances between side surfaces of the scroll blades 221 and 231 may create a seal sufficient for forming a satisfactory pocket(s).

On the other hand, in this example, a tip seal 260 is interposed between and disposed in contact with an axial (tip) end of the orbiting scroll blade 231 and the plate of the stationary plate scroll 220, at the front side 220F of the stationary plate scroll 220, to create a first axial seal which maintains the pocket(s) between the stationary and orbiting plate scroll blades 221 and 231. A second tip seal 260 is interposed between and disposed in contact with an axial (tip) end of the fixed scroll blade 221 and the plate of the orbiting plate scroll 230, at the front side 230F of the orbiting plate scroll 230, to create a second axial seal which maintains the pocket(s) between the stationary and orbiting plate scroll blades 221 and 231. Each tip seal 260 is a plastic member seated in a spiral groove in the tip of the scroll blade, i.e., a groove extending along the length of the scroll blade in the tip thereof.

The eccentric drive mechanism 240 includes a drive shaft 241 and bearings 246. In this example, the drive shaft 241 is a crank shaft having a main portion 242 coupled to the motor 300 so as to be rotated by the motor about a longitudinal axis L of the pump 1, and a crank 243 whose central longitudinal axis is offset in a radial direction from the longitudinal axis. The bearings 246 comprise a plurality of sets of rolling elements.

Also, in this example, the main portion 242 of the crank shaft is supported by the frame 210 via one or more sets of the bearings 246 so as to be rotatable relative to the frame 210. The orbiting plate scroll 230 is mounted to the crank 243 via another set or sets of the bearings 246. Thus, the orbiting plate scroll 230 is carried by crank 243 so as to orbit about the longitudinal axis of the pump when the main shaft 242 is rotated by the motor 300, and the orbiting plate scroll 230 is supported by the crank so as to be rotatable about the central longitudinal axis of the crank 243.

The metallic bellows 250 has a first end at which the bellows 250 is fixed to the back side 230B of the orbiting plate scroll 230 and a second end at which the bellows 250 is fixed to the frame 210. In this respect, the metallic bellows 250 is radially flexible enough to allow the first end thereof to follow along with the orbiting plate scroll 230 while the second end of the bellows remains fixed to the frame 210. On the other hand, the metallic bellows 250 has a torsional stiffness that prevents the first end of the bellows from rotating significantly about the central longitudinal axis of the bellows, i.e., from rotating significantly in its circumferential direction, while the second end of the bellows remains fixed to the frame 210.

The metallic bellows 250 may be essentially the only means of providing the angular synchronization of the stationary scroll blade 221 and the orbiting scroll blade 231 during the operation of the pump 1. Furthermore, not only does the metallic bellows 250 extend between the frame 210 and the back side 230B of the orbiting plate scroll 230, but the metallic bellows 250 also extends around a portion of the crank shaft 243 and the bearings 246 of the eccentric drive mechanism 240. In this way, the bellows 250 may also seal the bearings 246 and bearing surfaces from a space defined between the bellows 250 and the frame 210 in the radial direction and which space may constitute the working chamber, e.g., a vacuum chamber C of the pump, through which fluid worked by the pump passes. Accordingly, lubricant employed by the bearings 246 and/or particulate matter generated by the bearings surfaces can be prevented from passing into the chamber C by the bellows 250.

The cooling fan 400 is provided as part of a thermal management system to cool sources of heat of the pump. These heat sources include the pump motor 300 and the pump head assembly 200 as will be described in more detail later. Moreover, the levels of the noise and vibration are dependent on the thermal management system given that the cooling fan can be the dominant source of noise. In this respect, the noise of a cooling fan is a strong function of the tip velocity of the fan blades, which is directly proportional to the speed at which the fan is driven and dimensions of the fan such as the diameter of the rotary part of the fan.

A scroll pump according to the present invention is designed to minimize noise in one respect by ensuring that only one relatively compact cooling fan can cool all of the significant sources of heat in the pump. This aspect of the present invention will now be described in more detail.

Referring still to FIG. 1, the pump 1 also includes a shroud 120 disposed within the cowling 100. The shroud 120 extends around the pump motor 300 as spaced radially therefrom such that a tunnel T extending longitudinally in the axial direction of the pump is defined between (the outer peripheral surface of the housing of) the pump motor 300 and (an inner peripheral surface of) the shroud 120 within the cowling 100.

The tunnel T is open to and connects the air inlet 100A and the air outlet 100B, and the cooling fan 400 is disposed in the pump such that the cooling air flow produced by the cooling fan, as shown by the arrows AF, flows from the air inlet 100A to the air outlet 100B via the tunnel T to cool the sources of heat in the pump.

In this respect, the cooling fan 400 is a multi-speed or variable speed fan disposed upstream of the pump head assembly 200 in the pump 1, with respect to the direction of the cooling air flow produced by the fan 400, and the channel 100C (described below) traverses the pump head assembly 200. Therefore, the cooling air flow AF cools the pump head 200 assembly which is the primary source of heat in the pump 1. The cooling fan 400 is also disposed upstream of the pump motor 300 in the pump, with respect to the direction of the cooling air flow produced by the fan 400, and the tunnel T traverses the pump motor 300. Therefore, the cooling air flow AF also cools the motor which is the source of the second largest amount of heat in the pump 1.

In the embodiment of FIG. 1, the cowling 100 defines at least one channel 100C therein that channels the cooling air flow AF in the direction from the air inlet 100A towards the air outlet 100B, a first axial end of the tunnel T is open to and contiguous with the channel 100C, the other axial end of the tunnel T is disposed closer to the air outlet 100B than the first axial end, and the shroud 120 is a solid annular body and is integrated with the cowling 100 such that the channel 100C leads into the tunnel T only via the first axial end of the tunnel T.

Preferably, in this embodiment, the airflow area of the fan 400 is substantially the same as that of the tunnel T. The airflow area is the area of the air flow in a cross section perpendicular to the direction of flow. The airflow area of the fan 400 is the cross-sectional area of the cooling air flow at the location where the cooling air flow exits the fan 400. More specifically, and referring to FIG. 3, the cooling fan 400 has a hub 400A, fan blades 400B radiating from the hub, a housing 400C having an inner surface surrounding tips of the fan blades 400B, and a variable speed fan motor (not shown in the figure) connected to the hub 400A.

Figure 3:
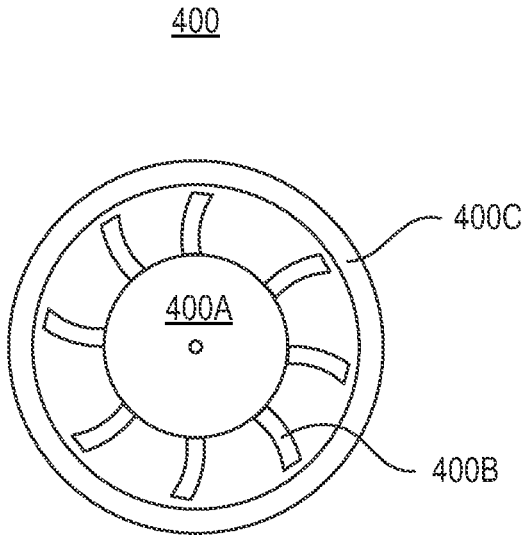
FIG. 3 is a schematic cross-sectional view of a cooling fan of the scroll pump, taken in the direction of line III-III' in FIG. 1.
Figure 4:
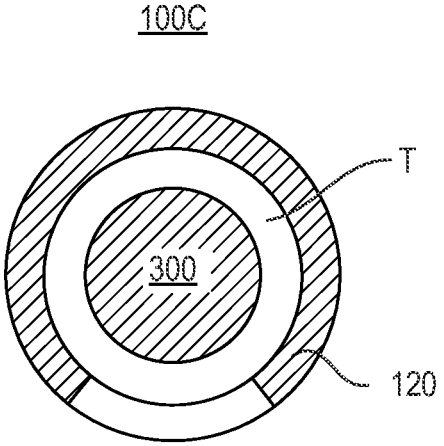
FIG. 4 is a schematic cross-sectional view of a pump motor and shroud of the scroll pump, taken in the direction of line IV-IV' in FIG. 1.

Referring now to FIGS. 3 and 4, the cross-sectional area of the space defined by and between the inner peripheral surface of the fan housing 400C and the outer peripheral space of the fan hub 400A, at the downstream end of the fan housing 400C, is preferably substantially the same as the maximal cross-sectional area of the tunnel T, namely, of the space defined by and between the inner peripheral surface of the shroud 120 and the outer peripheral surface of the pump motor 300. Note, in this respect the inner and outer peripheral surfaces of the shroud 120 and the pump motor 300 may be substantially cylindrical so that the cross-sectional area of the tunnel T is substantially uniform along the entire length of the tunnel T.

However, the airflow area of the tunnel T may be greater or less than that of the fan 400 to optimize the cooling of the pump motor 300. For a given output of the fan 400, the greater the airflow area of the tunnel T becomes, the greater is the volume of air that is displaced through tunnel T per unit time but the lower is the heat transfer coefficient at the boundary between the pump motor 300 and the airflow. The opposite effect occurs the smaller the airflow area of the tunnel T becomes. Preferably, the airflow area of the tunnel T is within a range of 50% to 200% of the airflow area of the fan 400.

Figure 5:
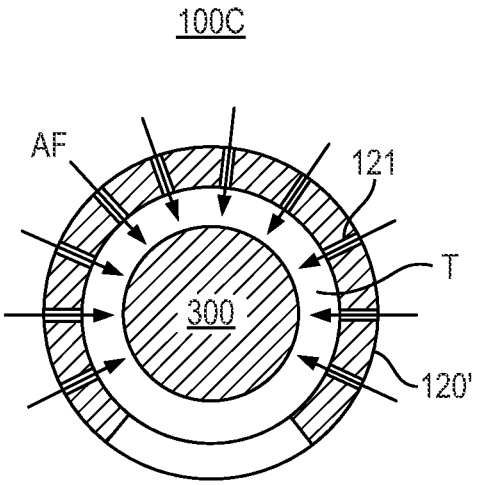
FIG. 5 is a cross-sectional view similar to that of FIG. 4 but of a scroll pump having another form of shroud surrounding the pump motor.

FIG. 5 shows an alternative form of the shroud 120'. Referring to FIGS. 1 and 5, the shroud 120' is an annular body having perforations 121 extending radially therethrough, and the perforations are open to the channel 100C such that the cooling air flow AF produced by the fan 400 flows through the perforations 121 and forms jets of air that impinge (the housing of) the pump motor 300 before flowing to the air outlet 100B. Cooling an object in this way, i.e., by directing jets of air that impinge the surface of the object, provides a cooling method known in the art, per se, as providing one of the highest heat transfer coefficients H. Thus, the perforated shroud 120' of FIG. 5 is very effective at facilitating the cooling of the pump motor 300.

Figure 6:
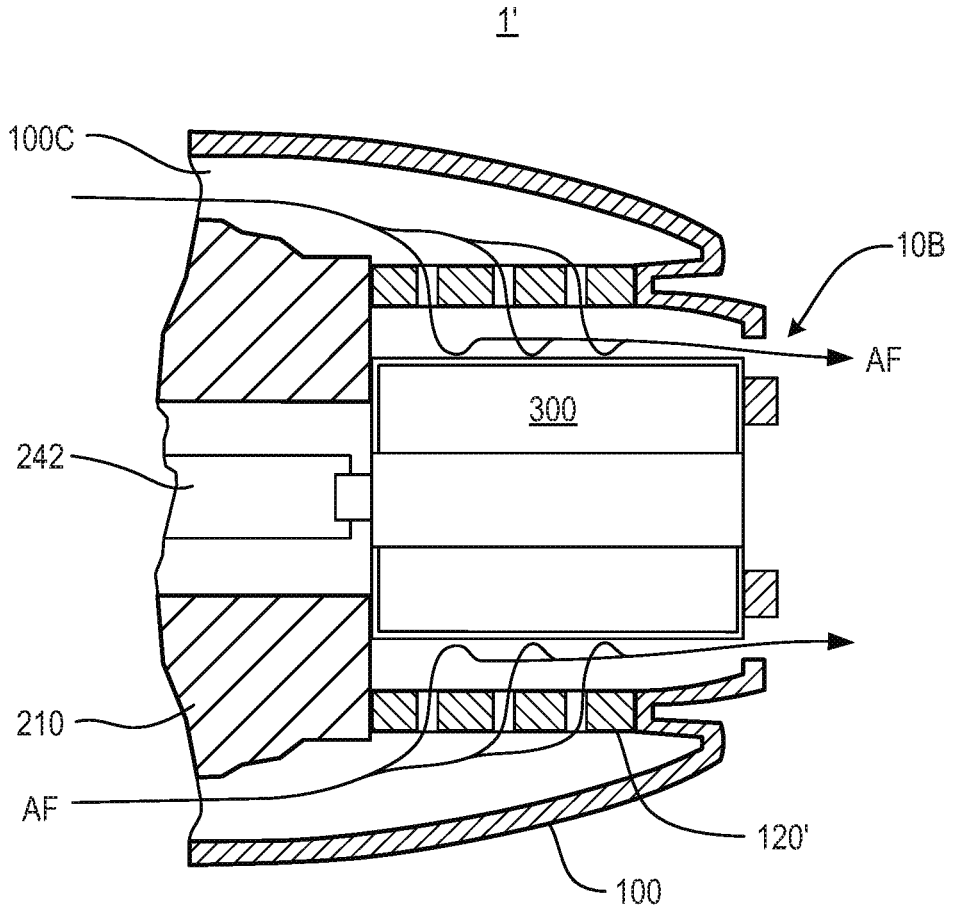
FIG. 6 is a schematic longitudinal sectional view of part of another embodiment of a scroll pump according to the present invention, which comprises a shroud of the type shown in FIG. 5.

Another embodiment of the scroll pump 1' is shown in FIG. 6. This embodiment employs the perforated shroud 120' and is otherwise similar to that of FIG. 1 except that both axial ends of the shroud 120' are sealed with respect to the channel 100C. Therefore, the cooling air flow AF produced by the fan 400 can flow into the tunnel T only through the perforations in the shroud 120'.

A scroll pump according to the present invention is designed to minimize noise in another respect by ensuring that cooling fan is driven at the lowest speed necessary to effectively cool (the heat sources of) the pump. This aspect of the present invention will now be described in more detail.

Figure 7:
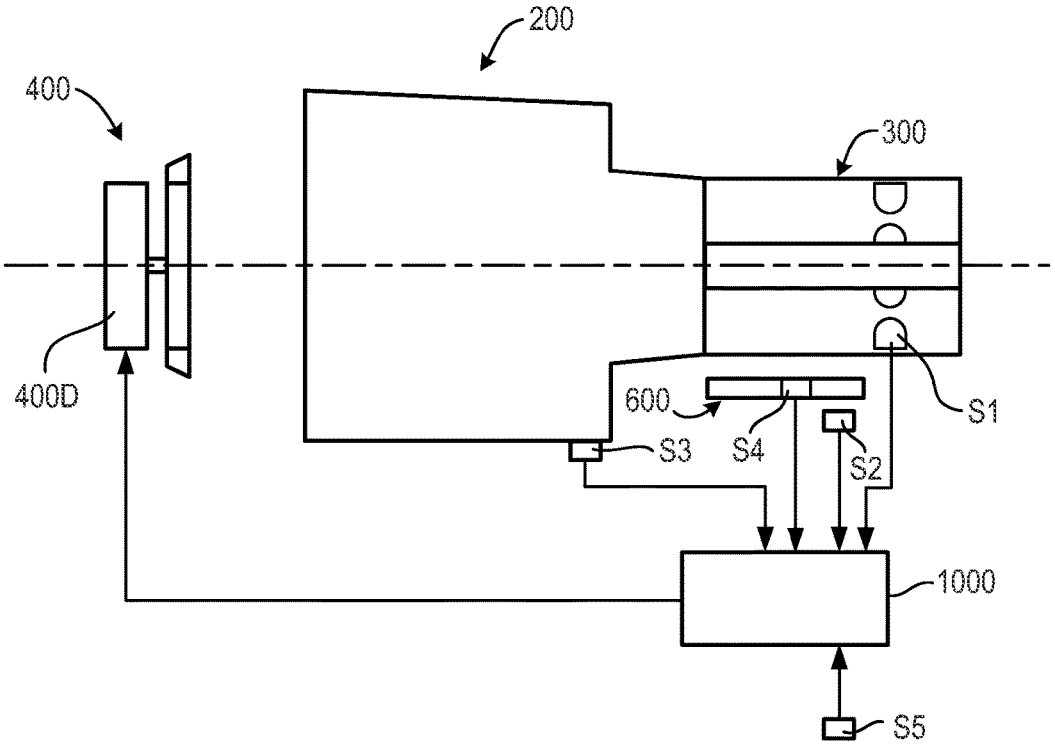
FIG. 7 is a block diagram of the scroll pump according to the present invention.

Referring to FIG. 7, the scroll pump 1 is also provided with an electronic control system that controls the operation of the pump. The electronic control system includes a circuit board 600 that controls the pump motor 300. The control of the pump motor 300 may refer to an operation of starting the motor 300. In the case in which the pump motor 300 is an inverter-controlled motor, the circuit board 600 may be an inverter board having circuitry that inverts the AC or DC voltage provided by the power source for the pump motor 300 to a variable frequency in order to operate the pump over a range of speeds. Such an inverter board is also a source of significant heat in the pump 1. The circuit board 600 may be received in a cut-out in the shroud 120 so as to be exposed to the tunnel T.

In addition to the circuit board 600 or as an alternative, other electronic components of the electronic control system, which are sources of heat in the pump 1, may be exposed to the at least one channel 100C defined by the cowling 100 so that the cooling air flow produced by the fan 400 passes over the electronic components and thereby cools the components before passing into the tunnel T. Therefore, the cooling air flow AF passes over and cools the circuit board 600 before flowing out through the air outlet 100C and/or a second air outlet 130.

For example, a circuit board 600 may be mounted to the base of the pump 1 beneath the pump head assembly 200, and the cowling 100 may have a separate opening 130 (also referred to as a second air outlet or auxiliary outlet) therethrough (FIG. 1) that induces part of the cooling air flow AF to pass over the circuit board 600. Thus, this circuit board 600 is cooled by the airflow AF before the airflow passes into the tunnel T or otherwise out of the pump through the second air outlet 130.

Referring now to FIG. 7, a scroll pump according to the present invention also has at least one sensor that monitors a respective load on the pump. Preferably, the at least one sensor includes a temperature sensor S1 operatively associated with of a winding of the pump motor 300 (in the case in which the pump motor is an electric motor) so as to sense a temperature of the winding. In the above-mentioned case in which the pump motor 300 is an inverter-controlled motor, the at least one sensor also includes a temperature sensor S2 operatively associated with the circuit board 600 (e.g., inverter board or motor start board) of the control system so as to sense a temperature thereof.

The at least one temperature sensor may also include a temperature sensor S3 associated with the pump head assembly 200 so as to sense a temperature of thereof, a sensor S4 operatively associated with the pump motor 300 so as to sense the power being drawn by the pump motor 300, and/or a temperature sensor S5 that senses a temperature of an ambient of the pump. Any type of appropriate temperature and power draw sensors known in the art, per se, may be used. For example, the power sensor S4 may comprise a current sensor and a low frequency voltage transformer whose outputs are both received by the controller 1000.

In addition to the circuit board 600, the electronic control system also has an electronic controller 1000, e.g., a microcontroller. In this example, the electronic controller is a digital microcontroller. The microcontroller may be mounted on the circuit board 600 along with the circuitry that controls the pump motor 300.

The controller 1000 is operatively connected to the sensor(s) S1, S2, S3, S4 and/or S5 and to a variable speed motor 400D of the multi-speed cooling fan 400. For example, the controller 1000 is operatively connected to the sensor(s) S1, S2, S3, S4 and/or S5 through a suitable interface, and to the variable speed motor 400D of the multi-speed cooling fan 400 so that the voltage applied to the motor 400D can be controlled by the electronic controller 1000 based on feedback from the sensor(s) as will now be described in more detail.

The electronic controller 1000 receives signals from the sensor(s) S1, S2, S3, S4 and/or S5 indicative of the load(s) on the pump, and has a processor that processes the signals to determine the thermal load on the pump, and based on the thermal load, issues a command to the fan motor 400D to drive the fan 400 at the lowest speed necessary to cool the pump sufficiently. As the fan speed is kept to a minimum, so is the noise of the pump.

A situation arises, though, when a tip seal 260 (refer back to FIG. 2) is first installed or is replaced as sometimes becomes necessary. The new tip seal 260 creates a relatively large amount of friction with the plate of the opposing scroll plate until the tip seal is worn down a certain amount. Thus, the new tip seal produces a relatively large amount of heat. Note, as is conventional in the art, a dedicated tip seal burnishing operation, in which the pump is run for some period of time without actually being used, is generally performed to wear in a newly installed tip seal. This operation to seat the tip seal ensures proper power draw and vacuum performance.

A method of controlling the speed of the cooling fan 400 to the optimum speed necessary to cool the pump sufficiently to prevent the pump from being damaged, e.g., to prevent the motor or electronic components from overheating, or to prevent the useful life of the parts of the pump from being shortened will now be described with reference to FIGS. 7 and 8.

First (S10 in FIG. 8), at least one load on the scroll pump is monitored by the at least one sensor the (S1, S2 . . . and/or S5) of the electronic control system.

The load(s) being monitored is analyzed (S20) by the controller 1000. The controller 1000 is configured with an algorithm by which situations resulting in abnormal operating temperatures or motor power draw, including a state of the pump in which a new tip seal has just been installed, can be discriminated in real time. That is, a state of the pump in which a new tip seal has just been installed can be discriminated from operating state(s) of the pump in which the tip seal has already been worn down by a given amount and therefore is not creating as much friction.

In fact, in the present embodiment, controller 1000 is configured with an algorithm by which the following three possible states of the pumps can be discriminated from one another based on the analysis of the load(s) on the pump:

State 1: The pump is operating at normal temperatures and power levels (for example, the power draw may be normally on the order of 500 W in the case of a line frequency of 50 Hz);

State 2: The pump is operating in an environment in which the ambient temperature is high or in which the load on the pump created by the fluid being worked by the pump is high; and State 3: The tip seal burnishing operation is taking place (for example, the power draw can be as high as 1000 W at the height of this operation compared to the above-mentioned 500 W under similar conditions but with the tip seal having been worn in).

State 1 requires a medium fan speed to minimize noise. State 2 requires a maximum fan speed to properly cool the pump and components. State 3 requires a low to medium fan speed to minimize pump motor power draw.

Figure 8:
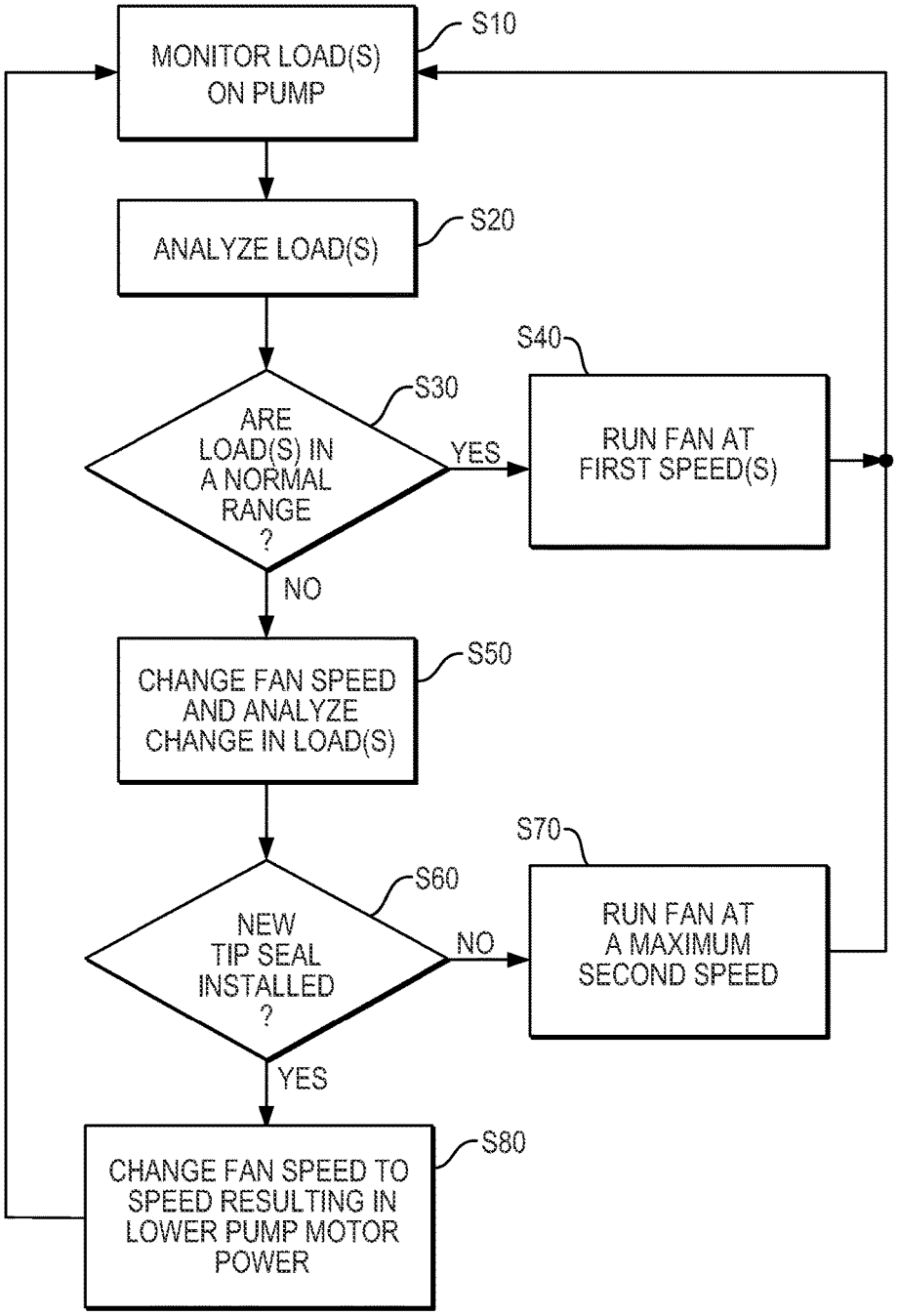
FIG. 8 is a flow chart of an example of a method of thermal management of a scroll pump, according to the present invention.

Referring still to FIGS. 7 and 8, the cooling fan 400 is controlled by the controller 1000 to run at a first speed or speeds within a predetermined range (S40) as long as the analysis (S20) indicates that the load(s) on the pump is/are within a normal range and the sensed temperature(s) is/are also normal, i.e., the pump in State 1. This medium (first) speed or range of speeds is/are selected to minimize fan noise while still providing adequate cooling.

If the pump is operating outside a normal range (NO in S30) the fan speed is changed (S50) according to a program and the load(s) on the pump is/are analyzed while the fan 400 is being driven at the new speed. The manner in which the load(s) changes/change as a result of changing the fan speed allows the controller 1000 to determine if a tip seal burnishing operation is in progress.

Basically, if the analysis (S50) determines that the pump is in State 2, then the cooling fan 400 is controlled by the controller 1000 to run at maximum (second) speed or speeds (S70) to provide the maximum amount of cooling air and largest heat transfer coefficient. On the other hand, if the pump is operating outside a normal range and the controller 1000 determines that this is due to a tip seal burnishing operation being in progress, then the cooling fan 400 is controlled by the controller 1000 to run at an optimum speed (S80) for burnishing a new tip seal. This optimum speed (produced when the method proceeds to S80) is generally below the first speed(s) produced when the method proceeds to S40).

The optimum speed of the fan 400 for burnishing a new tip seal is the fan speed which brings the power draw of the pump into a normal range and hence, significantly reduces the heat generation of the motor 300 and pump head 200. When burnishing a new tip seal, operating the fan 400 at a lower speed reduces the thermally induced crush on the tip seal, and hence the friction induced heat generation. In other words when burnishing a new tip seal, a lower fan speed actually results in lower operating temperatures, which is counter intuitive because it would be thought that a higher fan speed would result in lower operating temperatures.

The reason for this is as follows. Although a greater amount of heat is produced by the friction between a new tip seal 260 and the plate against which it is pressed, than by the friction between a worn-in tip seal and the same plate, the present inventors have discovered that the fan 400 keeps the back side 220B of the stationary plate scroll 220 and an outer wall of the frame 210 relatively cool whereas the heat is produced mainly at the front side 220F of the stationary plate scroll 220 and the front side 230F of the orbiting plate scroll 230. This results in a thermal expansion of an inner boss of the frame 210, which extends around the eccentric drive mechanism 240. The thermal expansion, in turn, results in the front side 220F of the stationary plate scroll 220 being brought closer to the orbiting plate scroll 230. Consequently, the clearance provided by the tip seal 260 is reduced and hence, a greater amount of friction and thus more heat is produced. Increasing the speed of the fan 400 at this time only would exacerbate this phenomenon. Therefore, the controller 1000, through its configuration, i.e., without any input from a user in the field, for instance, recognizes this situation and decreases the speed of the cooling fan 400 to an optimum speed to bring the motor power into a normal range while still providing a level of acceptable air flow. That is, the controller 1000 correlates a certain load(s) on the pump 1 with the first appreciable amount of heat produced by a new tip seal 260 and the temperature profile that follows as the new tip seal 260 is worn in. And so, it will be appreciated from the description above that the state in which a new tip seal 260 has just been installed may refer to the instantaneous state in the pump 1 before a new tip seal 260 begins to produce heat/friction in the pump 1.

Next, an example of a thermal management method in which the fan 400 is controlled according to the likelihood that the pump is operating in any of four different states, will be described with reference to FIGS. 7 and 9. In particular, in this example, the fan speed is regulated so as to be most beneficial or appropriate for (1) a state in which the pump is operating at normal temperatures and power levels, (2) a state in which the pump is operating in an environment in which the ambient temperature is high, (3) a state in which the load on the pump created by the fluid being worked by the pump is high and (4) a state in which the tip seal burnishing operation is taking place. To this end, the controller 1000 has the necessary electronic circuitry/components, e.g., memory, comparator, timer, etc., to execute a fan control process as described below.

Figure 9:
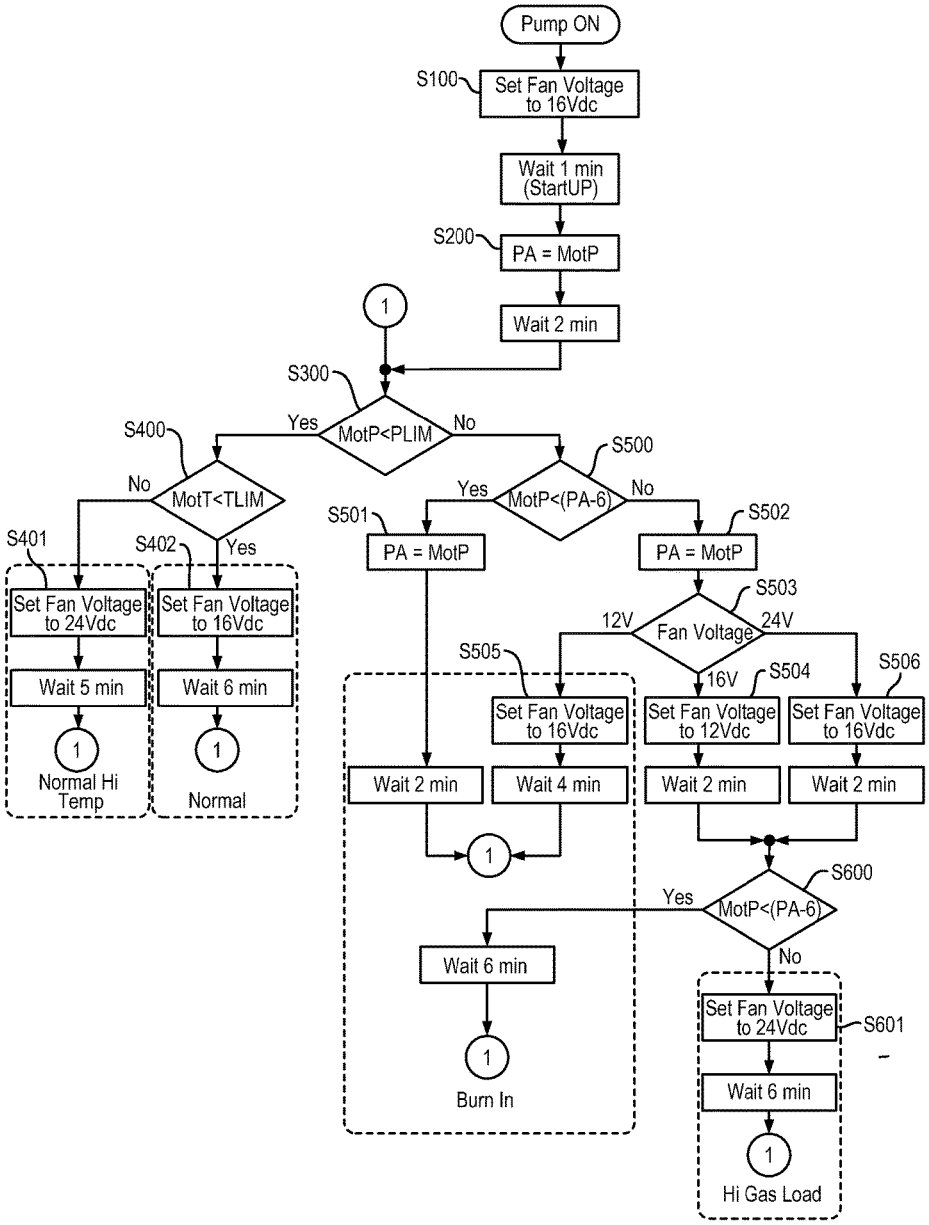
FIG. 9 is a flow chart of another example of a method of thermal management of a scroll pump, according to the present invention.

Referring to FIG. 9, when the pump is first turned on, (Pump ON), the fan 400 is run at a medium speed. To this end, a dc voltage of, for example, 16V is provided to the fan motor 400D under the control of the controller 1000 (S100).

Also, after a predetermined period of time, e.g., 1 minute, the power being drawn by the pump motor 300 (MotP) is measured based on the output of the sensor S4 at that time, and a value PA of the motor power draw (MotP) is stored as a variable in a memory of the controller 1000 (S200). The motor power draw (MotP), in this example, is calculated by the controller 1000 as the product of a voltage, current, and power factor. Depending on the type of pump motor that is used, the power factor and voltage may remain relatively constant independent of the load on the pump or motor voltage. In this case, the power factor and/or voltage may be stored in the memory of the controller as constant, and for all practical purposes the pump motor current could be used instead of pump motor power for the following discussion related to FIG. 9. In another type of pump motor, the power factor or voltage changes as the load on the pump changes or depending on the applied line voltage. In this case, therefore, the controller 1000 is configured to calculate a power factor and measure the voltage.

Next, and after another predetermined period of time, e.g., 2 minutes, the motor power draw MotP is compared with a power threshold PLIM representing normal operating states of the pump (S300). For example, if the line frequency of the power being supplied to the motor 300 is 50 Hz, the power threshold PLIM has a value of 500 W. If the line frequency of the power being supplied to the motor 300 is 60 Hz, the power threshold PLIM has a value of 600 W.

If the motor power draw MotP is less than the power threshold PLIM, then the temperature of the winding of the motor 300 (MotT) is measured based on the output of the sensor S1 and is compared with a motor temperature threshold TLIM representative of a high temperature but normal operating state.

On the one hand, if the motor winding temperature is greater than the motor temperature threshold TLIM, it may be considered that the pump is operating in a Normal Hi Temp state, i.e., it is more likely than not that the pump is in a state (2) as described above in which the pump is running normally but in a high temperature ambient. In this case, the fan 400 is controlled (S401) by the controller 1000 to run at a relatively high or maximum speed. To this end, a dc voltage of 24V, for example, is applied to the fan motor 400D to run the fan 400. Note also, in this example, the ambient temperature sensor S5 of the embodiment of FIG. 7 is rendered unnecessary, e.g., it can be inferred that the pump is in the Normal Hi Temp state without the use of an ambient temperature sensor. Next, and after a predetermined period of time, e.g., 5 minutes, has elapsed, the process checks whether the state of the pump has changed (S300) by measuring the power drawn by the pump motor 300 and comparing the measured motor power MotP with the power threshold PLIM.

On the other hand, in S400, if the measured winding temperature of the pump motor 300 (MotT) is not greater than the motor temperature threshold TLIM, then it can be considered that the pump is operating normally (i.e., it can be considered more likely than not that the pump is in state (1) above). In this case, the voltage applied to the fan motor 400D is set or remains set (S402) at the level that is applied when the pump is turned on, e.g., 16 Vdc. Then, the controller 1000 waits a predetermined period of time, e.g., 6 minutes, before the motor power MotP is again compared with the power threshold PLIM (S300) to check if the state of the pump has changed.

Referring again to the process at S300 in the process flow, in the case in which the measured motor power MotP is not less than the power threshold PLIM, then the measured motor power MotP is compared with a fraction of the previously measured motor power and whose value was stored as PA in the controller 1000. In the illustrated example, this fractional value of the motor power is PA−6 W. This fractional value was chosen so as to in effect filter out any random fluctuations in the motor power calculations caused by factors such as noise in the power lines or elsewhere.

If (at S500) the measured motor power MotP is less than the fractional value (PA−6 W in this example), then the current value of the measured motor power MotP is written in the memory of the controller 1000 as value PA (S501). That is, the value PA stored in the memory of the controller is replaced with or overwritten by the new value of the measured motor power MotP. In this case, it is considered that the current fan speed (high, low or otherwise) has had a beneficial result in reducing pump motor power. Rather than changing to a different fan speed, the controller 1000 then allows for a predetermined period of time, e.g., 2 minutes, to lapse to allow for the opportunity for further reductions in pump motor power before once again checking for a change in the operating state of the pump (according to the process beginning at S300 in the process flow).

Referring once again to the point in the process at S500, if the measured motor power MotP is not less than (PA−6 W) wherein PA is the value of the motor power (MotP) currently stored in the memory of the controller 1000, then at this time, too, the value PA stored in the memory of the controller is replaced with or overwritten by the new value of the measured motor power MotP (S502). Then one of three different processes is executed (beginning at S503 in the process flow) depending on the voltage that is being applied at that time to the fan motor 400D, i.e., depending on the fan speed at that time. The next several paragraphs will describe in detail the three different processes that are selectively executed beginning at S503 in the process flow.

First Process from Point S503 in the Process Flow

If the fan motor voltage has been previously set to 16 Vdc when the process arrives at S503, the voltage is now dropped to 12 Vdc (S504) and a predetermined period of time, e.g., 2 minutes, is allowed to elapse to determine if the lower fan speed will have a beneficial reduction in pump motor power.

Then (S600), the power draw on the motor 300 (MotP) is measured and compared with the fractional value of the motor power previously measured and the value PA of which is stored in the memory of the controller (PA−6 W in this example).

If the measured motor power is less than the fractional value of the motor power stored in the memory of the controller 1000, i.e., if MotP<(PA−6 W), than the lower fan speed has resulted in a beneficial drop in pump motor power most likely because a burnishing operation is in progress. That is, it is considered more likely than not that the pump is in state (4) above. Thus, the controller 1000 waits a predetermined period of time, e.g., 6 minutes to provide additional time for the burnishing operation to be completed. The process then proceeds by once again checking for a change in the operating state of the pump (according to the process beginning at S300 in the process flow).

On the other hand (still referring to S600 of the process), if the measured motor power MotP is not less than the fractional value of the motor power PA stored in the memory of the controller 1000, i.e., if MotP is not less than (PA−6 W), than the drop in fan speed was not beneficial, most likely because the pump is operating in a condition of Hi Gas Load. That is, it can be considered more likely than not that the pump is in state (3) as described above. In that case the fan speed is set to the highest speed by applying a voltage of, for example 24 Vdc, to the fan motor and the fan is left to run at the highest speed for at least a predetermined period of time, e.g. 6 minutes, before the operating state of the pump is checked again (according to the process beginning at S300 in the process flow).

Second Process from Point S503 in the Process Flow

When the process arrives at S503 and the fan motor voltage has been previously set to the maximum voltage, e.g. 24 Vdc, as a result of the execution of the above-described fan-setting process S601 (or S401), the fan voltage is now dropped, e.g. to 16 Vdc, to run the fan at a medium speed as a means to determine if the pump is still in the Hi Gas Load state (or Normal Hi Temp state). After a predetermined amount of time, e.g. 2 minutes, the pump motor power is measured and compared against the fractional value of the stored pump motor power (S600) to see if there has been a beneficial reduction in pump motor power as a result of the lower fan speed.

If in S600 of the process it is determined that there is no significant reduction in pump motor power draw, then the fan voltage is returned to the maximum voltage, e.g. 24 Vdc. On the other hand if in S600 of the process it is determined that there is a significant reduction in pump motor power, then the lower fan speed has resulted in a beneficial drop in pump motor power most likely again because a burnishing operation is in progress. In this case, the fan is kept at the medium voltage for a predetermined amount of time, e.g. 6 minutes, before once again checking for a change in the operating state of the pump (according to the process beginning at S300 in the process flow).

Third Process from Point S503 in the Process Flow

When the process arrives at S503 and the fan motor voltage has been previously set to the minimum voltage, e.g. 12 Vdc, as a result of the above-described fan-setting process S504 having been previously executed, the fan voltage is now increased (S505) to a medium voltage, e.g. 16 volts. The fan is left to run at the corresponding medium speed for a predetermined amount of time, e.g. 4 minutes, before the process flow returns to S300. The purpose of this process is to determine if the pump is still in the Burn In state (if a burnishing of a tip seal is still in progress) which requires a lower fan speed.

As should be clear from the description above, according to an aspect of this method, the power or current drawn by the pump motor is checked periodically, a process in which the fan speed is selectively changed is carried out, and the power draw or current on the motor as a result of changing the fan speed is analyzed to discriminate the state of the pump during the burnishing operation from at least one other state. In addition, the power drawn by the pump motor along with another load on the pump (e.g., pump motor winding temperature) may be analyzed to discriminate additional operating states of the pump. Of course, the discrimination of the states of the pump from one another refers to a conclusion that it is more likely than not that the pump is operating in one particular state as opposed to all other possible states. Then, an analysis of the load(s) (corresponding to S50 in FIG. 8) is used to control the speed of the cooling fan in a way most beneficial to the pump in consideration of the inferred operating state of the pump.

Finally, embodiments of the inventive concept and examples thereof have been described above in detail. The inventive concept may, however, be embodied in many different forms and should not be construed as being limited to the embodiments described above. Rather, these embodiments were described so that this disclosure is thorough and complete, and fully conveys the inventive concept to those skilled in the art. Thus, the true spirit and scope of the inventive concept is not limited by the embodiment and examples described above but by the following claims.

What is claimed is:

1. A method in a thermal management of a scroll pump having a stationary plate scroll including a stationary plate and a stationary scroll blade projecting axially from the stationary plate, an orbiting plate scroll having an orbiting plate and an orbiting scroll blade projecting axially from the orbiting plate, a tip seal interposed between an axial tip of the scroll blade of one of the plate scrolls and another of the plate scrolls, a pump motor operatively connected to the orbiting plate scroll for driving the orbiting plate scroll, and a cooling fan, the method comprising:

with a sensor, periodically measuring power or current being drawn by the pump motor and storing a value of the power or current each time it is measured in a controller;

each successive time the power or current being drawn by the pump motor is being measured, comparing the value of the measured power or current with the stored value of the previously measured power or current; and a fan control process executed by the controller includes reducing or increasing a speed at which the fan is running, while the scroll pump is operating, when a comparison between a) the value of the measured power or current being drawn by the pump motor and b) the stored value of the previously measured power or current yields a given result, wherein the periodic measuring of the power or current being drawn by the pump motor includes measuring the power or current being drawn by the pump motor after each time the speed of the cooling fan is reduced or increased once a given time has elapsed, and the fan control process executed by the controller also includes maintaining a reduced fan speed for a predetermined period of time when the comparison between a) the value of the power or current being drawn by the pump motor, measured once said given time has elapsed after the speed of the fan has been reduced or increased, and b) the stored value of the previously measured power or current is such that the comparison indicates that the power or current being drawn by the pump motor is in a state of a tip seal burnishing created by friction of the tip seal and the power or current can be reduced by operating the cooling fan at a reduced speed.

2. The method as claimed in claim 1, wherein the measuring of the power being drawn by the pump motor comprises sensing at least one of the current flowing to the pump motor, the voltage being applied to the pump motor, and a power factor of the motor.

3. The method as claimed in claim 1, wherein the periodic measuring comprises comparing the measured power or current being drawn by the pump motor with a power or current threshold value that remains constant.

4. The method as claimed in claim 1, further comprising measuring a temperature of a winding of the pump motor, and comparing a measured temperature of the winding with a pump motor temperature threshold value, wherein the fan control process includes controlling the fan to run at a first speed when the temperature of the winding of the pump motor is less than the pump motor temperature threshold value, and controlling the fan to run at a second speed greater than the first speed when the temperature of the winding of the pump motor is not less the motor temperature threshold value.

5. The method as claimed in claim 4, wherein the measured temperature of the winding is compared with the motor temperature threshold value only when the measured pump motor power or current is less than the power or current threshold value.

6. The method as claimed in claim 1, wherein the comparison comprises determining whether the measured power or current is less than a fraction of the stored value of the previously measured power or current.

7. The method as claimed in claim 6, further comprising the reducing or increasing the speed at which the fan is running only when the measured power or current is not less than the fraction of the stored value of the previously measured power or current.

8. The method as claimed in claim 7, further comprising measuring a temperature of a winding of the pump motor, and comparing a measured temperature of the winding with a pump motor temperature threshold value, wherein the fan control process includes controlling the fan to run at a first speed when the temperature of the winding of the pump motor is less than the pump motor temperature threshold value, and controlling the fan to run at a second speed greater than the first speed when the temperature of the winding of the pump motor is not less the motor temperature threshold value.

9. The method as claimed in claim 1, wherein the fan control process comprises changing the voltage applied to a motor of the cooling fan.

* * * * *